US010388195B1

(12) United States Patent
Rowland

(10) Patent No.: US 10,388,195 B1
(45) Date of Patent: Aug. 20, 2019

(54) RURAL ROAD AID

(71) Applicant: James Neil Rowland, Washington C.H., OH (US)

(72) Inventor: James Neil Rowland, Washington C.H., OH (US)

( * ) Notice: Subject to any disclaimer, the term of this patent is extended or adjusted under 35 U.S.C. 154(b) by 0 days.

(21) Appl. No.: 16/350,076

(22) Filed: Sep. 24, 2018

(51) Int. Cl.
*G09F 13/16* (2006.01)

(52) U.S. Cl.
CPC ..... *G09F 13/16* (2013.01)

(58) Field of Classification Search
CPC ..... G09F 13/16; G09F 2007/1804; G09F 2007/1878
See application file for complete search history.

(56) References Cited

U.S. PATENT DOCUMENTS 4,084,914 A * 4/1978 Humphrey ..... E01F 9/629 256/1
4,841,708 A * 6/1989 Johnston ..... E04G 1/12 249/18
5,953,841 A * 9/1999 Sawyer ..... G09F 15/0087 40/124.191
6,158,379 A * 12/2000 Burlando ..... G09F 7/18 116/63 P
6,233,898 B1 * 5/2001 Burlando ..... G09F 13/14 116/63 P
6,428,197 B1 * 8/2002 Downing ..... B60Q 1/245 362/269
9,208,706 B1 * 12/2015 Baron ..... G09F 15/0075
2002/0124448 A1 * 9/2002 Seville ..... G09F 13/14 40/582
2006/0037224 A1 * 2/2006 Lienau ..... G09F 7/00 40/606.03
2014/0041269 A1 * 2/2014 Benumof ..... G09F 7/18 40/607.11
2015/0187236 A1 * 7/2015 Beckley ..... G09F 7/18 40/607.03

* cited by examiner

*Primary Examiner* — Gary C Hoge

(57) ABSTRACT

The item is a single piece of metal folded in the center so that it can be used as a double sided sign. Each side would have reflective tape applied. One side would have green reflective tape and the other side would have red reflective tape.

4 Claims, 5 Drawing Sheets

RURAL ROAD AID

BACKGROUND

The purpose of this project is to aid drivers on rural roads especially at night. A lot the rural roads are not marked as well as the more traveled roads. Many rural roads do not have marked center lines or edge of the road lines. Road name signs are not uniformly placed to identify side roads. The Rural Road Aid signs would be a great help to motorists traveling the rural roads day or night.

SUMMARY

The sign is a white enamel coated aluminum metal cut to the size 16" by 6" and folded in the center of the longer 16" side to form a double sided sign approximately 7.5" in height by 6" in width with 1" between the two sides. The sign would have a hole drilled in the bottom centers of the two ends. The sign with the folded side up would slide down over a metal post and be attached to the post with one (1) ⅜" by 1⅜" bolt. The sign would have a red reflective tape, 6¾" in height by 5" in width. The opposite side of the sign would have a green reflective tape the same size, 6¾" in height by 5" in width. The Rural Road Aid project would require two signs, one on each side of the side road. The sides with the red reflective tape would face each other and the sides with the green reflective tape would face away from each other. The signs would be placed perpendicular to the main road. A motorist would see the green reflective sign first and then the red reflective sign second. The motorist would know to pass between the green sign and the red sign.

DESCRIPTION

The Rural Road Aid will be a sign or signs, since two are required, to be of help to a motorist identify a side road that exits from a main road in a rural area. Since many rural area roads have no center lines, no side of the road lines and the side roads names are not uniformly marked or placed. The Rural Road Aid sign would be of 0.04 gauge, 16" by 6" white enamel coated aluminum. A pair of these signs would be required as there would be one on each side of the side road. As the motorist approaches the road to turn onto, the driver would first see the nearest sign, the green reflective side and then see the second sign, the red reflective sign, and know to turn or enter between the two signs. Since each sign has both colors of reflective tape, the driver can see to turn regardless of which direction said driver is heading. The aluminum 16" by 6" pieces can be purchased as such. The aluminum pieces can be cut from larger stock. It is available in 4' by 8' sheets and can be cut into 48, 16" by 6" pieces. The 16" by 6" pieces can be pressed over a solid center jig to form the "U" shaped piece. A slotted jig can be used with a drill press to cut the holes that will later be used to attach it to a post. The post would be 6' with approximately 2 feet in the ground and 4' above ground. The posts can be purchased from several different manufactures. The reflective tape is made by 3M and can be purchased from a 3M distributor. The tape would be cut from a roll and placed on the sign by hand. The white enameled background outlines and helps the reflective tape to show up better.

DESCRIPTION OF DRAWINGS

The drawing referred to as FIG. 1 shows the front view of the sign. The actual size is 7.5 inches in height and 6.0 inches in width of the folded 16 inch by 6 inch piece of metal. The numbered portions of the sign refer to the sections of the sign. 1 is the metal sign. 2 is the reflective tape. 3 is the hole that would be used when attaching it to a post. 4 shows the folded area.

Figure 1:
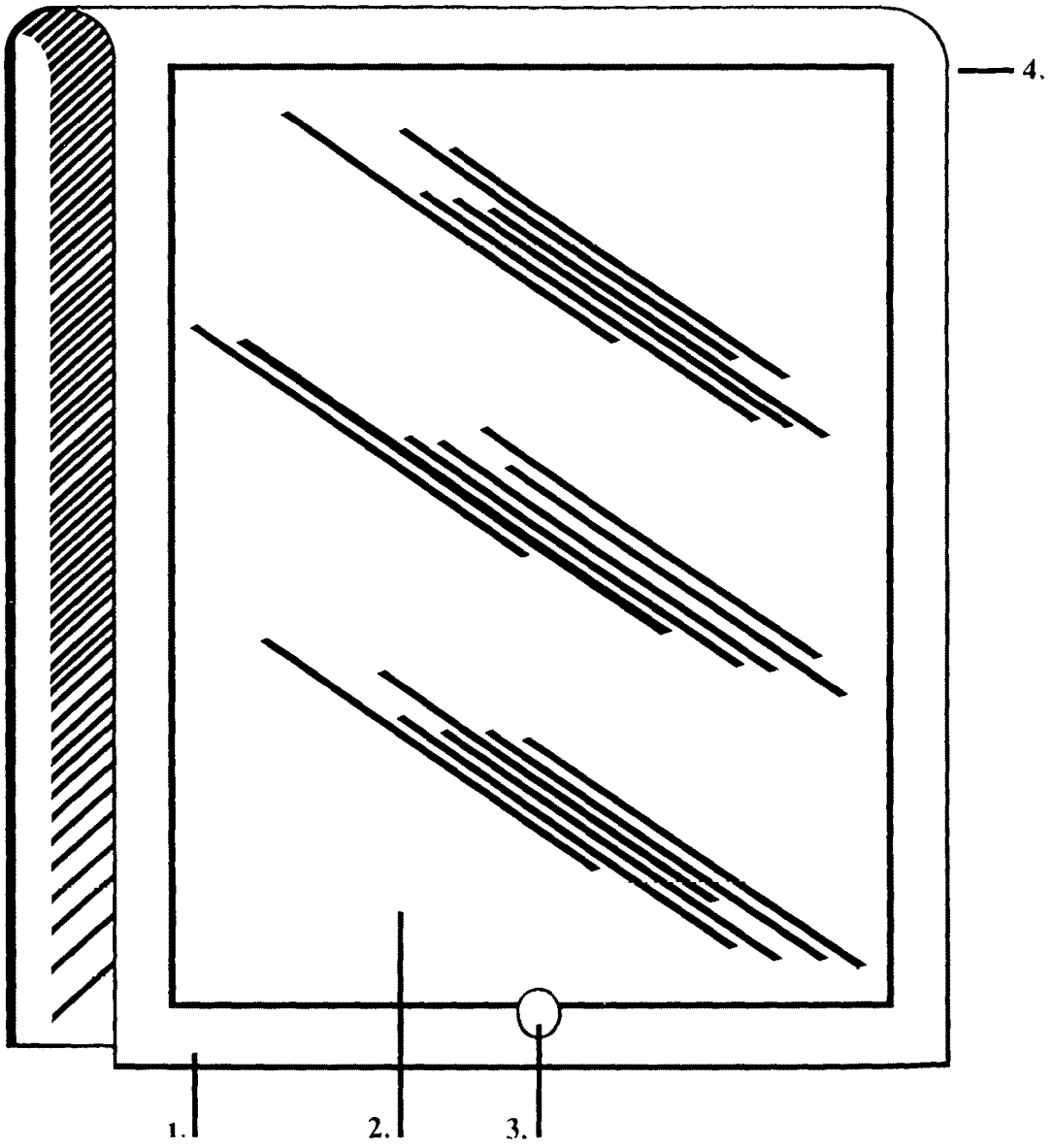
Figure 2:
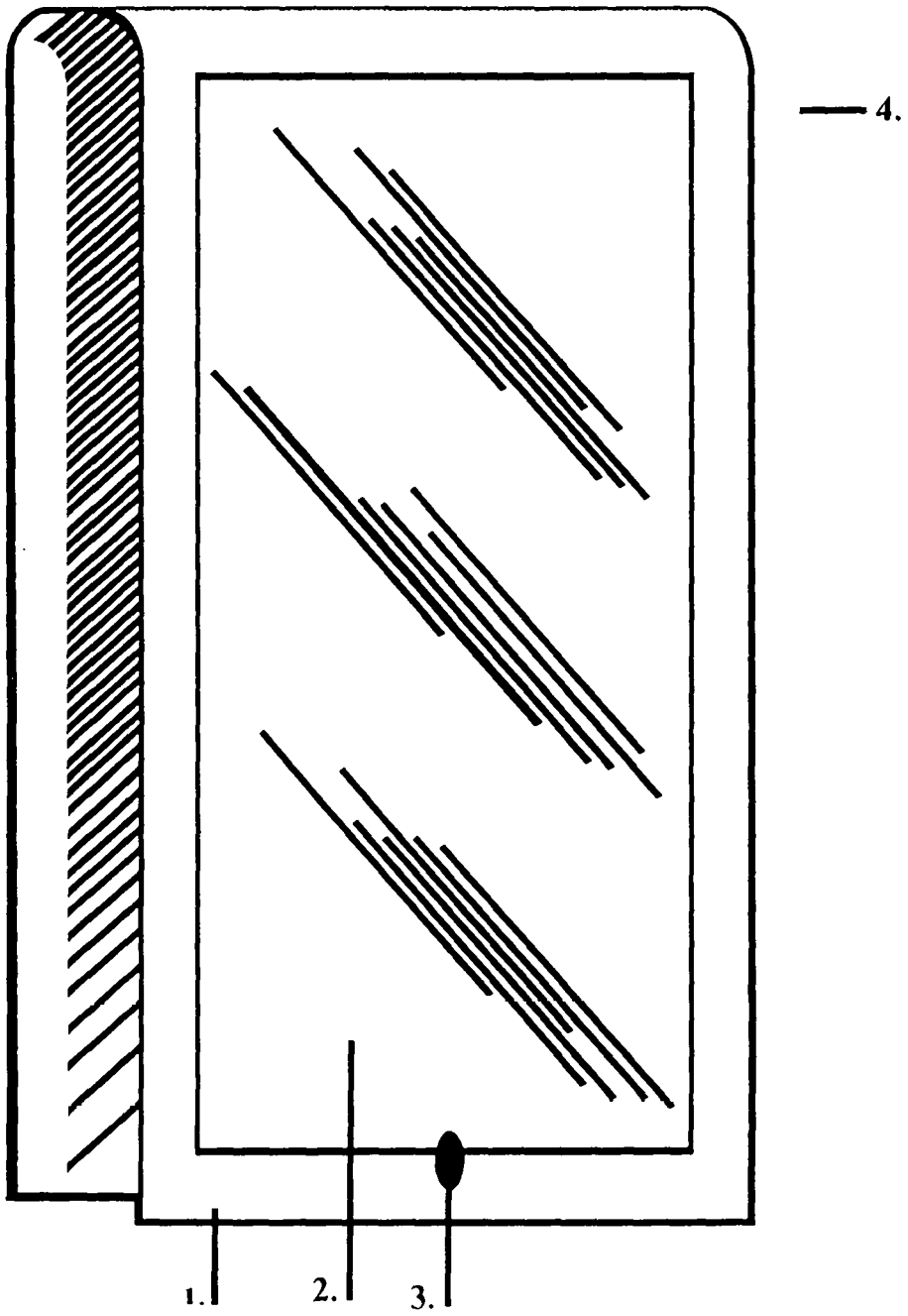
In FIG. 2 the drawing shows a ¾ view of the sign in which the references, numbers 1, 2, 3, 4, are shown.
Figure 3:
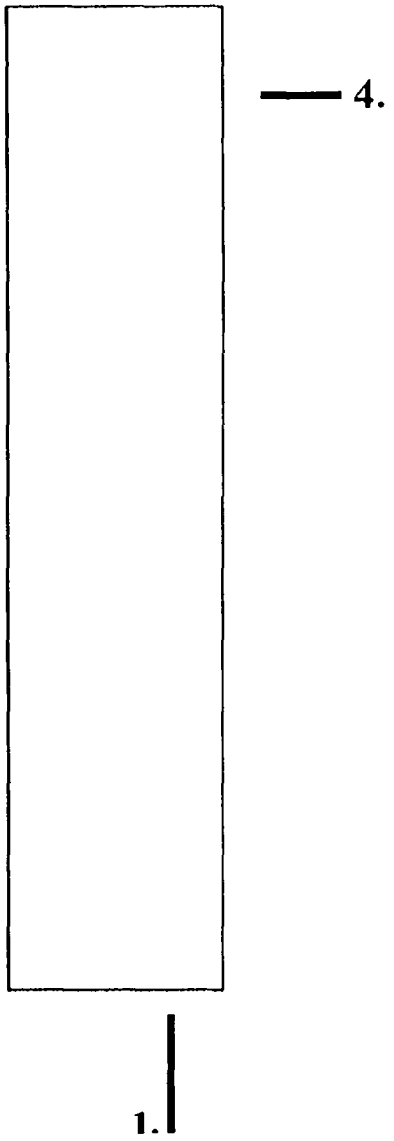
FIG. 3 is a view of the top of the sign.
Figure 4:
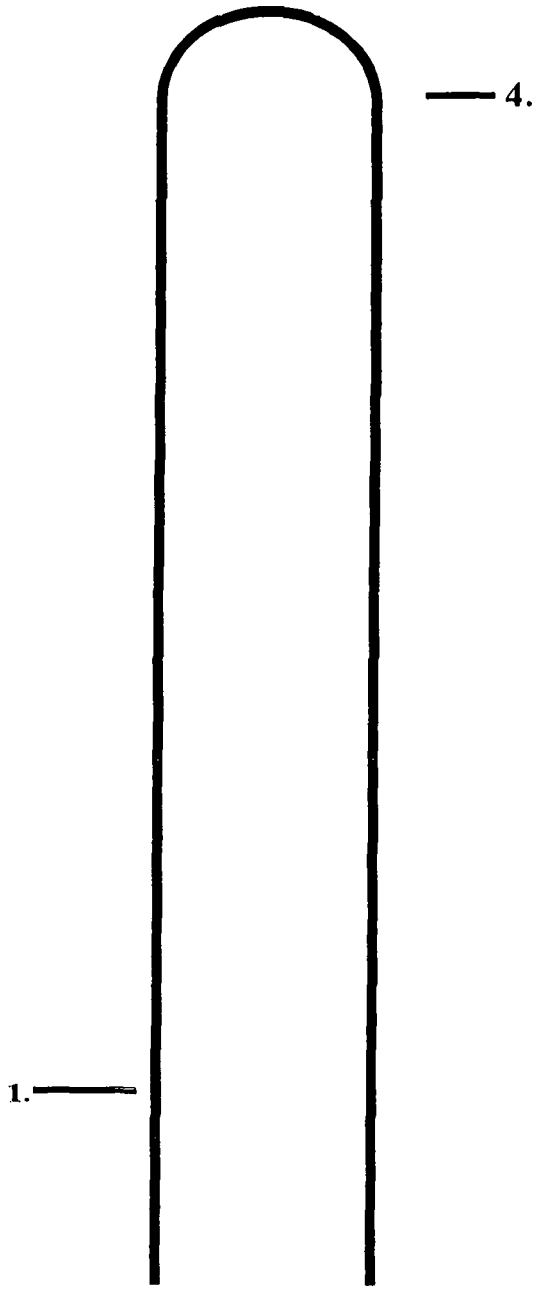
FIG. 4 is a view from the side and shows 1 and 4.
Figure 5:
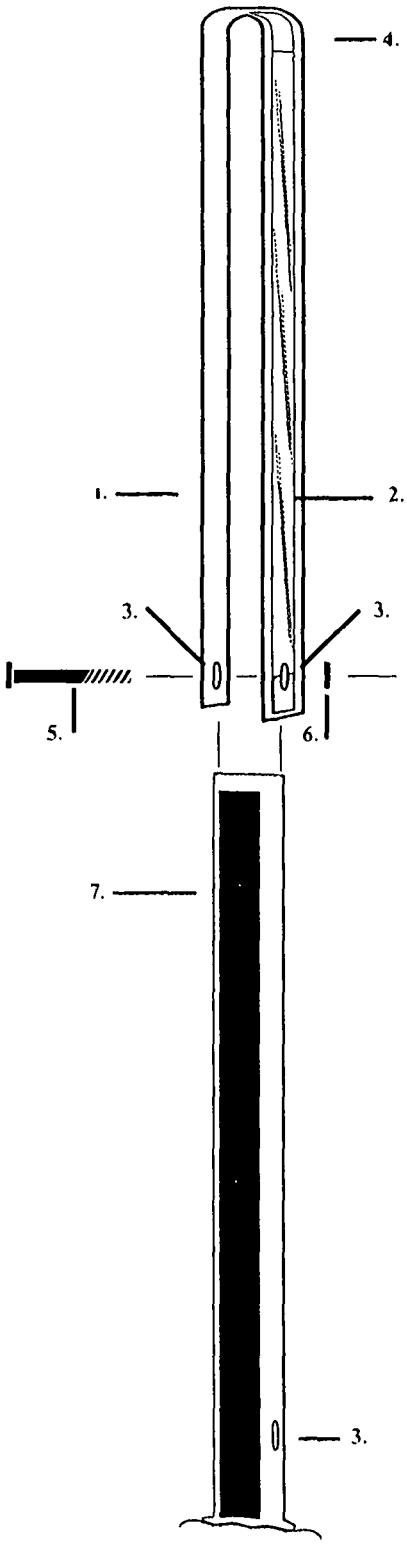
FIG. 5 shows from the side as to how the item would look, with 1 being the metal sign, 2 being the reflective tape, 3 being the holes for the attachment to the post and 4 the top fold. 5 and 6 represent the bolt and nut used in attaching the sign to the post, 7.

The invention claimed is:

1. A rural road aid sign comprising a rectangular metal sheet folded in half to create a u-shaped article comprising a first side and a second side, with an arch spanning between the first side and the second side, the arch forming a space between the first side and the second side; a white enamel coating covering at least the first side and the second side; reflective tape applied to the first side and to the second side, whereby the rural road aid sign can fit over a ground-mounted post such that the post is accommodated between the first side and the second side.

2. The rural road aid sign of claim 1, wherein the article is six inches wide, the first side and the second side are 7½ inches long, and the space is 1 inch wide.

3. The rural road aid sign of claim 1, wherein the reflective tape applied to the first side is green, and the reflective tape applied to the second side is red.

4. The rural road aid sign of claim 1, further comprising a hole drilled through at least one of the first and second sides, proximate a bottom edge thereof, whereby the article can be fastened to the post with a fastener.

* * * * *